US011223095B2

(12) United States Patent
Martin-Iglesias et al.

(10) Patent No.: US 11,223,095 B2
(45) Date of Patent: Jan. 11, 2022

(54) WAVEGUIDE FILTER

(71) Applicant: European Space Agency, Paris (FR)

(72) Inventors: Petronilo Martin-Iglesias, Noordwijk (NL); Fernando Teberio, Pamplona (ES)

(73) Assignee: EUROPEAN SPACE AGENCY, Paris (FR)

( * ) Notice: Subject to any disclaimer, the term of this patent is extended or adjusted under 35 U.S.C. 154(b) by 0 days.

(21) Appl. No.: 16/938,394

(22) Filed: Jul. 24, 2020

(65) Prior Publication Data

US 2021/0028526 A1 Jan. 28, 2021

(30) Foreign Application Priority Data

Jul. 26, 2019 (EP) ..... 19188701

(51) Int. Cl.

| | |
|---|---|
| ***H01P 1/208*** | (2006.01) |
| ***H01P 1/211*** | (2006.01) |
| ***H01P 1/20*** | (2006.01) |
| ***H01P 1/213*** | (2006.01) |

(52) U.S. Cl.

CPC ..... *H01P 1/208* (2013.01); *H01P 1/2005* (2013.01); *H01P 1/211* (2013.01); *H01P 1/213* (2013.01)

(58) Field of Classification Search

CPC ..... H01P 1/208; H01P 1/2005; H01P 1/213; H01P 1/209; H01P 1/211

USPC ..... 333/236, 239, 245, 248

See application file for complete search history.

(56) References Cited

U.S. PATENT DOCUMENTS

2020/0373644 A1* 11/2020 Goulouev ..... H01P 7/06

OTHER PUBLICATIONS

Extended European Search Report for corresponding EP Application No. 19188701.7, dated Jan. 17, 2020.

Miranda Luis et al., "Stepped-Impedance Band-Pass Filters with Improved Selectivity", 2019 IEEE MTT-S International Microwave Symposium (IMS), Jun. 2, 2019, pp. 1198-1200.

Yang Zhenxing et al., "Design of High Efficiency Broadband Continuous Class-F Power Amplifier Using Real Frequency Technique With Finite Transmission Zero", IEEE Access, vol. 6, Oct. 9, 2018, pp. 61983-61993.

Minnis BJ, "Decade bandwidth bias T's for MIC applications up to 50 GHz", IEEE Transactions on Microwave Theory and Techniques, Plenum, USA, vol. MTT-35, No. 6, Jun. 1, 1987, pp. 597-600.

Yimin Yang et al., "Advanced Synthesis Technique for Unified Extracted Pole Filters", IEEE Transactions on Microwave Theory and Techniques, vol. 64, No. 12, Dec. 1, 2016, pp. 4463-4472.

* cited by examiner

*Primary Examiner* — Rakesh B Patel
*Assistant Examiner* — Jorge L Salazar, Jr.
(74) *Attorney, Agent, or Firm* — Dinsmore & Shohl LLP

(57) ABSTRACT

The present disclosure relates to a filter for filtering wavelengths of an electromagnetic signal to provide a filtered signal. The filter includes: at least one commensurate-line structure (CLS); and, at least one stub-modified commensurate-line structure (SMCLS) arranged to provide a corresponding at least one transmission zero in the filtered signal.

16 Claims, 8 Drawing Sheets

WAVEGUIDE FILTER

CROSS-REFERENCE TO RELATED APPLICATIONS

The present application claims priority to European Patent Application No. 19188701.7, entitled "Waveguide Filter," filed Jul. 26, 2019, the entirety of which is incorporated by reference herein.

TECHNICAL FIELD

The present application is concerned with waveguide filters for use in communication, in particular telecommunication.

BACKGROUND

Recently, the space industry has focused on the exploration of the Q/V/W bands for future commercial telecommunication programs. These architectures use waveguide bandpass filters (BPFs) to remove unwanted spurious signals coming from other instruments embarked in the same platform or in-ground transmitters.

Classical solutions for waveguide BPFs in Q/V/W-bands use the traditional concept of coupled resonant cavities. Indeed, inductive filters are the most commonly employed solutions thanks to better theoretical radio frequency (RF) performance in terms of quality factor (Q-factor). However, the accuracy of the usual manufacturing tools (e.g. the standard computer controlled milling) becomes more significant, due to the reduced physical dimensions of these filters at higher frequencies. This can lead to imprecise fabrications, which result in a need for high-precision computer controlled manufacture (CCM) and/or the use of tuning screws which can lead to time-consuming, expensive manufacturing processes and additional ohmic losses. For frequencies beyond Q-band, tuning becomes increasingly effort intensive due to the size of the waveguides. Additionally, filter structures based on resonant cavities tend to suffer for imperfections in the clamshell manufacturing due to the high currents and imperfections in the flanges.

When sharp rejection near the passband is required, a solution based on folded topologies, transversal networks or simple extracted poles can be envisaged. However, due to the high mutual interaction between resonant structures, the design task can be technically difficult and also time consuming.

Embodiments of the present disclosure are directed to waveguide filter topologies that are less sensitive to manufacturing tolerances and that are able to provide high rejection near the passband.

The present disclosure will also have use across any field requiring high frequency waveguide filtering. The present disclosure may be of relevance to high frequency systems (such as telecommunications and Earth observation) as well as ground applications conducted at high frequencies. The present disclosure may provide a high frequency filter where a small footprint, low signal losses and low cost are desirable.

Moreover, to solve the above issues, a novel BPF is disclosed herein which can meet the stringent specifications in high-frequency bands with multiple transmission zeros and with a dramatic improvement in the manufacturing yield, which allows the fabrication of the novel filters with low-cost fabrication techniques.

For example, at lower frequencies (for example up to Ka-band), in order to reduce the size and/or footprint and hence, insertion loss of a waveguide BPF, several transmission zeros are often included in the frequency response by adding extra coupled resonant cavities or by coupling complex dual-mode resonators to reduce the required order of the filter. This is presently done in a number of ways outlined below.

One modern technique involves adding additional coupled resonant cavities to the input and/or output ports. This is not intensive in relation to the design procedure, since the resonant BPF and the extra resonant cavities which produce the transmission zeros are designed independently, subsequently connected and slightly optimized afterwards. The main advantage of this procedure is the short optimization time needed after the design stage. A drawback of this arrangement is the required size and also the limited number of transmission zeros that can be added.

Another technique to include transmission zeros in a waveguide BPF is rather involved. In this technique, the extra resonant cavities which produce the transmission zeros are coupled to the resonant cavities which, in part, form the BPF. Unlike the first technique described above, the BPF and any of the resonant cavities which produce the transmission zeros cannot be designed individually. Synthesis methods have been developed to design these types of structures. The advantages are that more transmission zeros can be added in comparison with the technique described above and more compact structures can be obtained. However a drawback is that a long final optimization might be required due to the interaction between the resonant cavities of the filter and the resonant cavities which produce the transmission zeros. The complexity increases exponentially when considering a high number of transmission zeros. Optimization of such filters is therefore a significantly involved process.

A further technique to obtain transmission zeros in the frequency response of a BPF is to use multiple-mode (i.e. dual-mode) resonant coupled cavities. These structures are proficient for narrow waveband filters but, in most cases, there is a reliance on tuning screws to retrieve the desired frequency behavior as such structures are very sensitive to manufacturing tolerances. Additionally, although using dual mode configurations, solutions are rather bulky due to the working mode usually selected.

Other methods such as transversal topologies or use of non-resonant modes have been also used to implement transmission zeros. However, designs based on these approaches tend to be difficult for design and tuning due to the reduced number of variables which impact in several functional parameters (e.g. transmission zeros etc.).

The above design techniques utilize resonant coupled cavities. Indeed, compact structures which fulfil stringent specifications can be achieved. However, these techniques are very sensitive to the manufacturing tolerances. In the lower frequency bands (e.g. up to about 30 GHz), this is not a barrier to suitable functionality as tuning screws can be added to retrieve the frequency performance of the filter after the fabrication. Nevertheless, for the new applications in Q/V/W-bands, the implementation of the tuning screws is a significant problem. In these bands, the dimensions of the resonant cavities are of the same order of magnitude as the fabrication tools which are therefore not precise enough. Therefore, waveguide filter topologies which are less sensitive to manufacturing tolerances are of interest.

SUMMARY

Aspects of the present disclosure are set out in the accompanying claims.

Viewed from a first aspect there is provided a filter for filtering wavelengths of an electromagnetic signal to provide a filtered signal, the filter including: at least one commensurate-line structure (CLS); and, at least one stub-modified commensurate-line structure (SMCLS) arranged to provide a corresponding at least one transmission zero in the filtered signal.

Filters that operate at high frequencies, for example in the Q/V/W band (around 33 GHz to around 110 GHz in total), that allow isolated passbands and specific stopbands may be desirable. The present disclosure is directed to a filter that has a reduced construction time over known filters and that has effective and simplistic optimization protocols in comparison to known filters. Furthermore, inclusion of additional stopbands to provide additional rejection frequencies does not exponentially increase the difficulty of any subsequent optimization of the filter, as is often the case with known filters.

Thus, according to the present disclosure, optimization of a filter can occur in a less time consuming and work intensive manner. Furthermore, construction is easier thereby reducing the need for expensive construction methods Construction of the filter can occur by production of the CLS followed by production of the SMCLS, formed to provide desired transmission zeros in the filtered signal. The two types of structures are then combined to provide a filter which has effective filtering alongside reduced sensitivity to manufacturing tolerances.

The desired passband and transmission zeros may be independently designed and therefore a very short optimization may be required during assembly of the different sections of the filter later in construction of the filter.

In an embodiment, the at least one CLS and the at least one SMCLS may form a band-pass filter.

Formation of the band pass filter enables the device to limit the bandwidth of the output signal to an allocated band for transmission.

In an embodiment, at least the at least one CLS or the at least one SMCLS may be a rectangular waveguide.

The use of a rectangular waveguide may enable the user to control the propagation of waves through the filter.

In an embodiment, the at least one SMCLS performs an extracted pole.

The provision of the extracted pole assists in the accurate delivery of a transmission zero in the wave filter function.

In an embodiment, the filter may be arranged to provide a filtered signal in the microwave and millimeter-wave frequency bands.

High frequency wavelengths may be advantageously filtered by the present disclosure. The filtering of high frequency wavelengths is of interest to numerous commercial areas.

In an embodiment, the filter may comprise at least one CLS and at least one SMCLS arranged to form a stepped-impedance structure.

A stepped-impedance structure allows the user to obtain a band pass filter filtering performance. This enables the user to have greater control the performance of the filter.

In an embodiment, the filter may be arranged to provide a passband between about 95 and 105 GHz with greater than about 50 dB of attenuation between about 81 to 85 GHz and about 112 to 125 GHz.

Such a range is specifically advantageous for use in specific systems requiring such a filtering performance.

In an embodiment, the filter may provide five transmission zeros in a band between 80 and 130 GHz.

Such a range is specifically advantageous for use in specific systems requiring such a filtering performance.

In an embodiment, at least one SMCLS may be positioned adjacent to at least one CLS.

The arrangement provided in this embodiment may provide a compact filter.

In an embodiment, the at least one SMCLS may comprise a quarter-wave bandstop element and may be connected to the at least one CLS.

This arrangement may provide both a compact and efficient filter. The use of a quarter-wave bandstop may enable a user to controllably introduce a transmission zero in the filter performance.

In an embodiment, the quarter-wave bandstop element may be positioned in the at least one SMCLS and may be connected to a higher impedance section of the at least one CLS.

The arrangement provided in this embodiment may provide a compact filter.

In an embodiment, the quarter-wave bandstop element may be positioned in the at least one SMCLS and may be connected to a lower impedance section of the at least one CLS.

The arrangement provided in this embodiment may provide a user with great control over the location of an effective transmission zero in the filter performance.

In an embodiment, the filter may be formed via a clamshell configuration cut by the E-plane.

This manufacturing method is efficient and cheap and enables the user to form the present filter.

Viewed from a second aspect there is provided a filter for filtering wavelengths of an electromagnetic signal to provide a filtered signal, the filter comprising a plurality of stub-modified commensurate-line structures (SMCLS) arranged to provide at least a corresponding plurality of transmission zeros in the filtered signal.

Filters that operate at high frequencies, for example in the Q/V/W band (33 GHz to 110 GHz in total), that allow isolated passbands and specific stopbands are desirable. The present disclosure provides such a filter that has a reduced construction time over known filters and that has effective and simplistic optimization protocols in comparison to known filters. Furthermore, inclusion of additional stopbands to provide additional rejection frequencies does not exponentially increase the difficulty of any subsequent optimization of the filter, as is often the case with known filters. Furthermore, filters according to the present disclosure provide a compact filter.

Thus, according to the present disclosure, optimization of a filter can occur in a less time consuming and work intensive manner. Furthermore, construction is easier thereby reducing the need for expensive construction methods In an embodiment, at least one of the plurality of SMCLS performs an extracted pole.

The provision of the extracted pole assists in the accurate delivery of a transmission zero in the wave filter function.

Viewed from a third aspect there is provided a method for constructing a filter for filtering wavelengths of an electromagnetic signal to provide a filtered signal, the method including: providing at least one CLS; providing at least one SMCLS, positioning the at least one SMCLS adjacent to the at least one CLS.

In an embodiment, positioning the at least one SMCLS adjacent the at least one CLS may include positioning the SMCLS adjacent to a higher impedance section of the CLS.

The method provided in this example may provide a user with great control over the location of an effective transmission zero in the filter performance.

In an embodiment, positioning the at least one SMCLS adjacent the at least one CLS may comprise positioning the SMCLS adjacent to a lower impedance section of the CLS.

The method provided in such embodiment may provide a user with great control over the location of an effective transmission zero in the filter performance.

In an embodiment, providing at least one SMCLS may include: providing at least one quarter-wave bandstop element as part of the at least one SMCLS, wherein the quarter-wave bandstop element is arranged to provide one transmission zero in the filtered signal.

The provision of a quarter-wave bandstop may enable a user to controllably introduce a transmission zero in the filter performance.

In an example, the quarter-wave bandstop element may be arranged to provide one transmission zero within the frequencies 1 GHz to 300 GHz.

Such a range is specifically advantageous for use in specific systems requiring such a filtering performance. The filter may provide a filtering function over a broad range of frequencies.

In an embodiment, providing at least one CLS may comprise: providing a baseline step-impedance band pass filter to provide a predetermined passband within the frequencies of about 33 GHz to 110 GHz.

Such a range is specifically advantageous for use in specific systems requiring such a filtering performance.

BRIEF DESCRIPTION OF THE DRAWINGS

One or more embodiments of the present disclosure will now be described, by way of example only, and with reference to the following figures in which.

Figure 1:
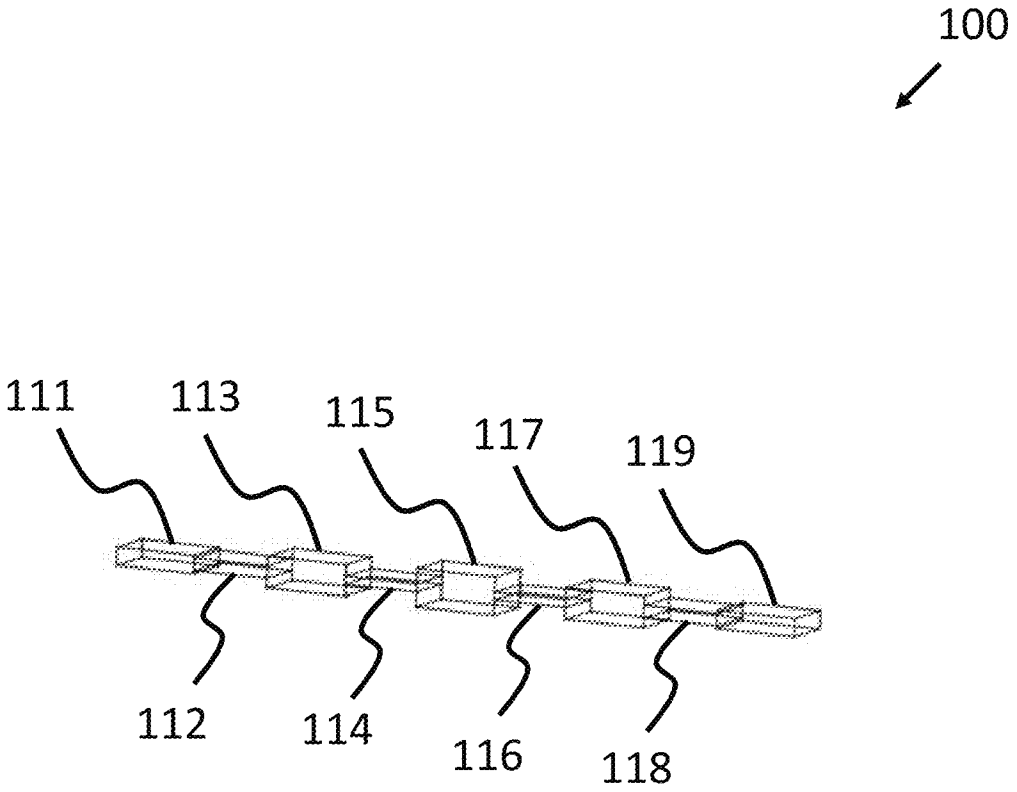
FIG. 1 shows a perspective view of a filter, according to one or more embodiments shown and described herein.

Any reference to prior art documents in this specification is not necessarily to be considered an admission that such prior art is widely known or forms part of the common general knowledge in the field. As used in this specification, the words "comprises", "comprising", and similar words, are not to be interpreted in an exclusive or exhaustive sense. In other words, they are intended to mean "including, but not limited to". The present disclosure is further described with reference to the following embodiments. It will be appreciated that the claims of the present disclosure are not intended to be limited in any way by these embodiments. It will also be recognized that the present disclosure covers not only individual embodiments but also combination of the embodiments described herein.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the present disclosure as defined by the claims or limitations on equivalents to the claims, and that other embodiments may be utilized and modifications may be made without departing from the spirit and scope of the claims. Various embodiments of the present disclosure may suitably comprise, consist of, or consist essentially of, appropriate combinations of the disclosed elements, components, features, parts, steps, means, etc., other than those specifically described herein. In addition, this disclosure may include other embodiments not presently claimed, but which may be claimed in future.

DETAILED DESCRIPTION

One or more embodiments described herein relate to a waveguide band-pass filter. A particular filter may be a microwave or millimeter-wave filter and involves having at least one commensurate-line structure (CLS) and at least one stub-modified commensurate-line structure (SMCLS). In embodiments, the at least one CLS or the at least one SMCLS is a rectangular waveguide.

The one or more embodiments disclosed herein is related to waveguide band-pass filters. The described filter allows the transmission of some desired frequencies of an electromagnetic signal while rejecting other frequencies. These frequencies can be preselected for transmission/rejection by a user and the filter may be designed and manufactured according to those specifications. The filter disclosed herein enables precise transmission and rejection of frequencies in a novel and inventive manner.

An SMCLS may be formed from a CLS and a waveguide bandstop element, performing a transmission zero. The transmission zero is designed independently and subsequently connected to additional CLS sections of a filter and, finally, a slight optimization is performed to obtain the final performance of the novel band-pass filter topology.

As disclosed herein, the SMCLS of the filter may provide one or multiple transmission zeros in the rejection of the filter. The passband of the filter has a number of poles which is related directly to the number of CLSs contained within the filter. The number of poles may be in a relationship of 1:1 for the number of poles to the number of CLSs in the filter. In embodiments, at least one of the plurality of SMCLS performs an extracted pole. The provision of the extracted pole assists in the accurate delivery of a transmission zero in the wave filter function.

FIG. 1 shows an arrangement of a filter 100. The filter 100 is in a form produced following a commensurate approach wherein the filter 100 has a plurality of CLSs 111, 112, 113, 114, 115, 116, 117, 118, 119. These CLSs 111 to 119 are connected so as to provide a baseline filter to a signal incident on the filter 100. The filter 100 shown in FIG. 1 can provide a desired passband and minimum attenuation in the stopband as desired by the user. The filter 100 may be a stepped impedance structure, as understood by one of skill in this field.

Figure 2:
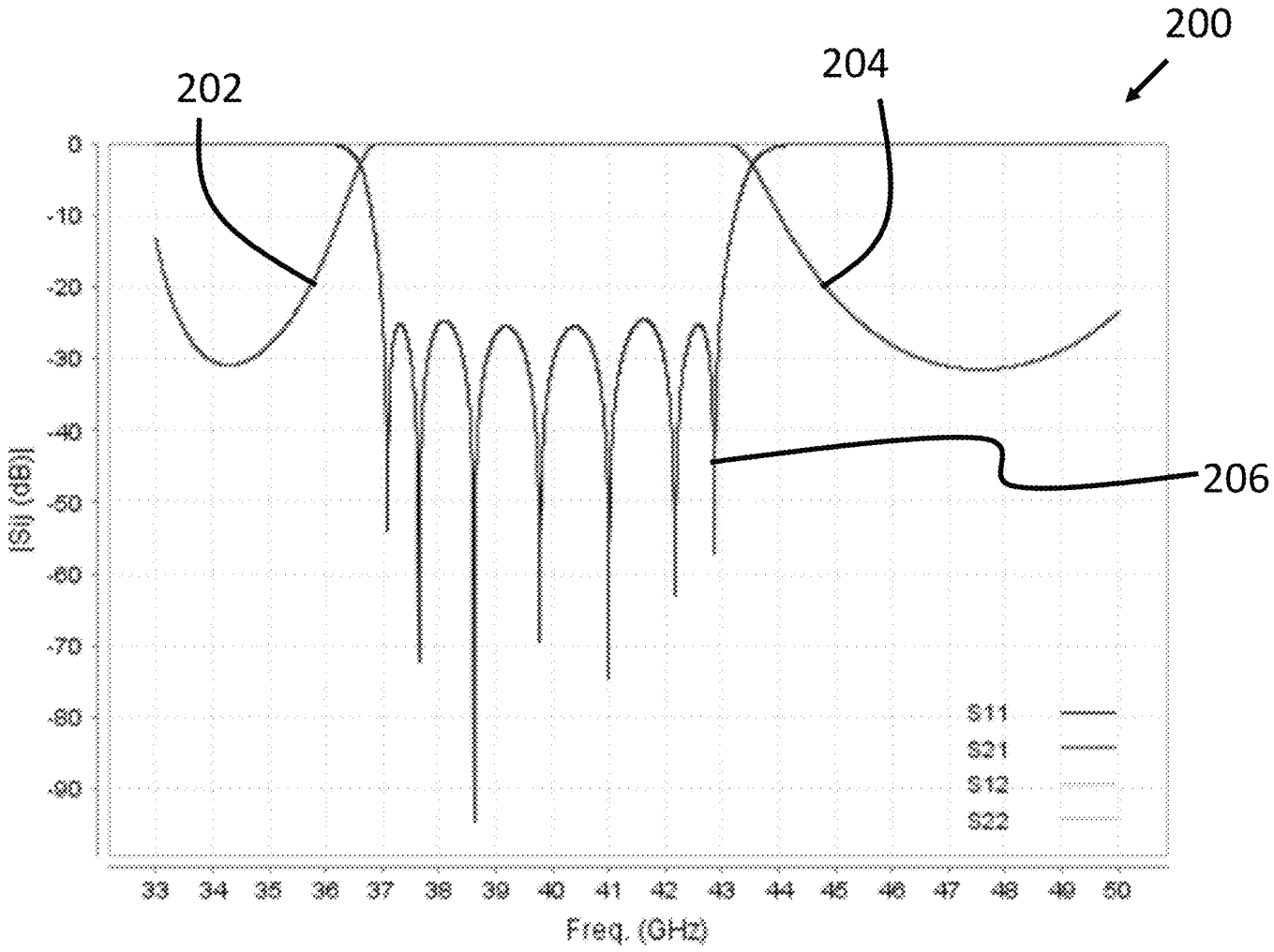
FIG. 2 shows a graph plot of the filter response provided by the filter of FIG. 1, according to one or more embodiments shown and described herein.

FIG. 2 shows a graph plot 200 of a filtered signal produced by the filter 100 of FIG. 1. The plot 200 has axes of frequency in GHz along the X-axis against filter response in dB along the Y-axis. The plot 200 has two lines, one relating to the S11 performance of the filter 100 and one relating to the S21 performance of the filter 100. The S21 line has been split into two line portions 202, 204 for clarity of the following description.

The plot 200 illustrates that the filter 100 provides a rejection of around −30 dB at bands around the frequency of 34 GHz and the frequency of 47 GHz. The rejection illustrated by the S21 plot around 34 GHz is shown by line portion 202, while the rejection illustrated by the S21 plot around 47 GHz is shown by line portion 204. The characterization of the input of the filter 100 is shown by the S11 plot shown in plot 200. The S11 plot is shown by line 206.

Figure 3:
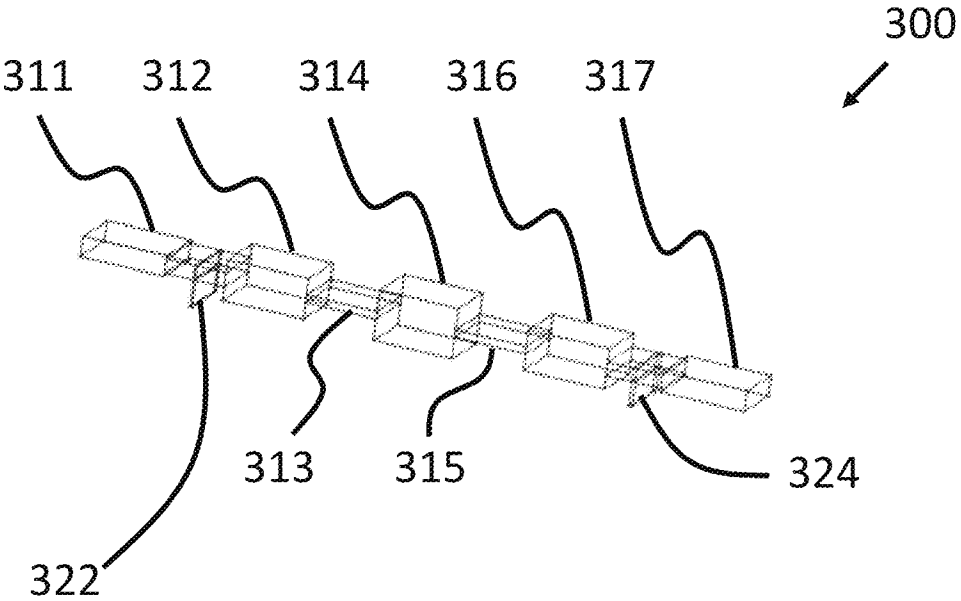
FIG. 3 shows a perspective view of a filter, according to one or more embodiments shown and described herein.

FIG. 3 shows an arrangement of a filter 300. The filter 300 is in a form produced by combining seven CLSs 311, 312, 313, 314, 315, 316, 317, with two SMCLSs 322, 324. The stubs are shown in the embodiment of FIG. 3 and can be seen to project downwardly from the main axis along which the CLSs 311 to 317 and the SMCLSs 322, 324 are arranged. The CLSs 311 to 317 are arranged in a similar manner to the CLSs 111 to 119 shown in FIG. 1. In the example arrangement shown in FIG. 3, the SMCLSs 322, 324 are connected on either end of the respective SMCLSs 332, 324 to CLSs 311, 312, 316, 317. In the specific embodiment of a filter 300 shown in FIG. 3, the first SMCLS 322 is located between the first CLS 311 and the second CLS 312 and the second SMCLS 324 is located between the sixth CLS 316 and the seventh CLS 317. The second CLS 312 is connected to the third CLS 313, which is connected in turn to the fourth CLS 314, and so on with the fifth CLS 315 and the sixth CLS 316. This is an exemplary arrangement and variations of this arrangement are possible to provide differing filter responses as desired by a user.

In an embodiment, the stubs of the SMCLSs 322, 324 project downwardly from the SMCLSs 322, 324. The transmission zeros in the response of the filter 300 are provided by the SMCLSs 322, 324. The SMCLSs 322, 324 can be designed independently of the CLSs 311 to 317 which provide the desired passband and minimum attenuation in the stopband as desired by the user. The design of the SMCLSs 322, 324 may involve designing quarter-wave bandstop elements to provide the desired effect on the response of the filter 300. The SMCLSs 322, 324 are then connected to the CLSs 311 to 317 to form the filter 300. A slight optimization may then be performed to refine the performance of the filter 300 to user desired levels.

The filter 300 shown in FIG. 3 is a stepped impedance structure. To form the stepped impedance structure to obtain a band-pass filter a filter may have one CLS and one SMCLS or, in some examples, two SMCLSs. In the examples shown herein, there are combinations of CLSs and SMCLSs however the filters shown herein could be formed from SMCLSs only.

In the embodiment of FIG. 3, the SMCLSs 322, 324 are connected to lower impedance sections of the filter 300. The performance of the filter 300 is illustrated as a graph plot 400 in FIG. 4. The graph plot 400 is a similar plot to that shown in FIG. 2, in terms of the axes and the lines plotted on the graph plot 200. The line shapes of the plot 400 are different to those in plot 200.

Figure 4:
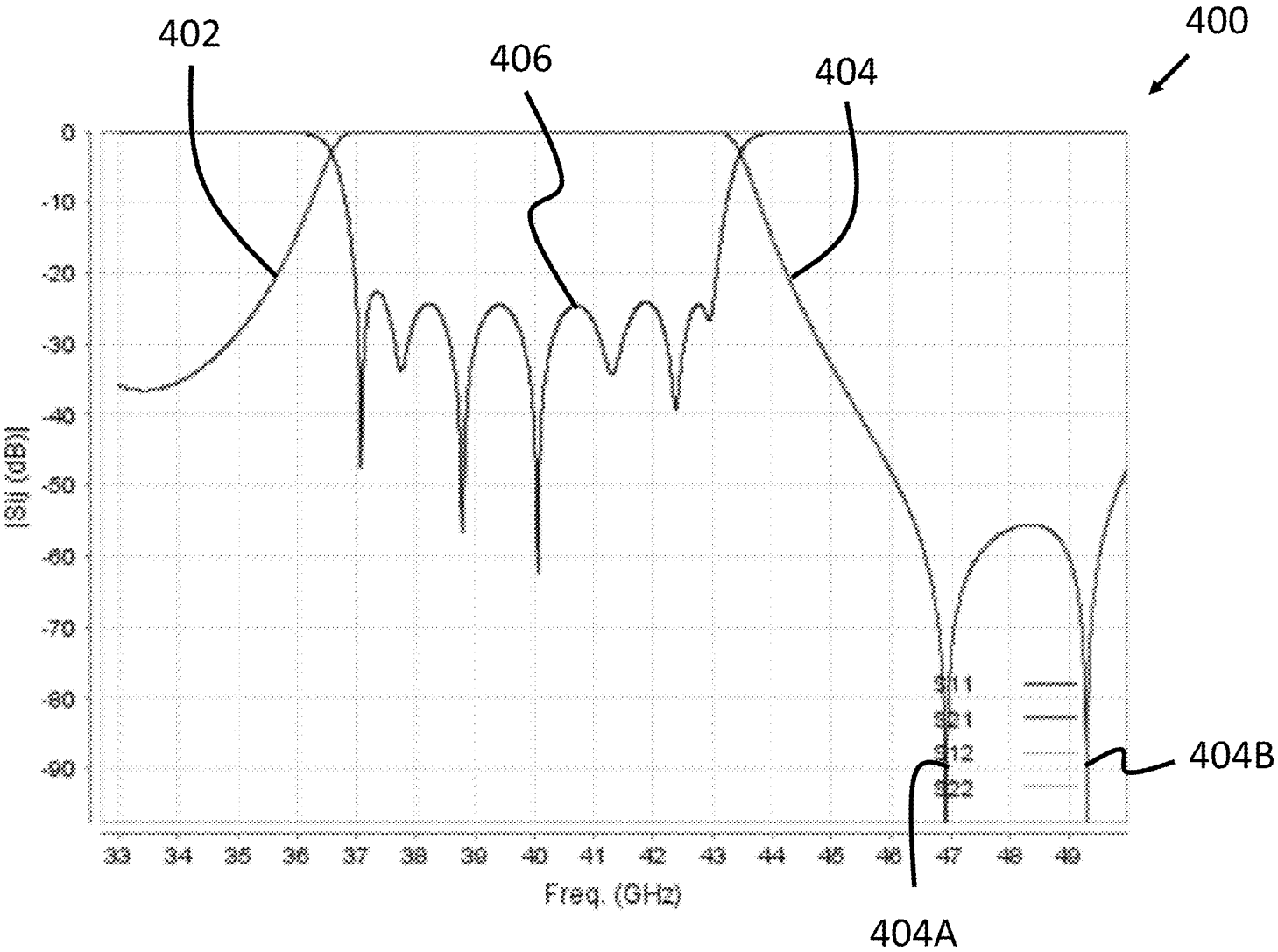
FIG. 4 shows a graph plot of the filter response provided by the filter of FIG. 3, according to one or more embodiments shown and described herein.

The plot 400 illustrates that the filter 300 provides a rejection of around −40 dB at a band around the frequency of 33 GHz. This response of the filter 300 is shown by line portion 402. Turning to line portion 404 as shown in FIG. 4, the plot 400 also illustrates that the filter 300 provides two transmission zeros at around 47 GHz and around 49 GHz. These two transmission zeros are shown within line portion 404 as line portions 404A and 404B for the 47 GHz and 49 GHz transmission zeros respectively.

Notably, the plot 400 shown in FIG. 4 has the two transmission zeros, illustrated in plot 400 by line portions 404A and 404B, located in the S21 plot on the right side (higher frequency end) of the stopband. As with FIG. 2, the characterization of the input of the filter 300 is shown by the S11 plot shown in plot 400. This plot is shown by line 406. As shown in FIG. 4, there are 7 poles in line 406. This corresponds to the seven CLSs 311 to 317 in the filter 300.

Figure 5:
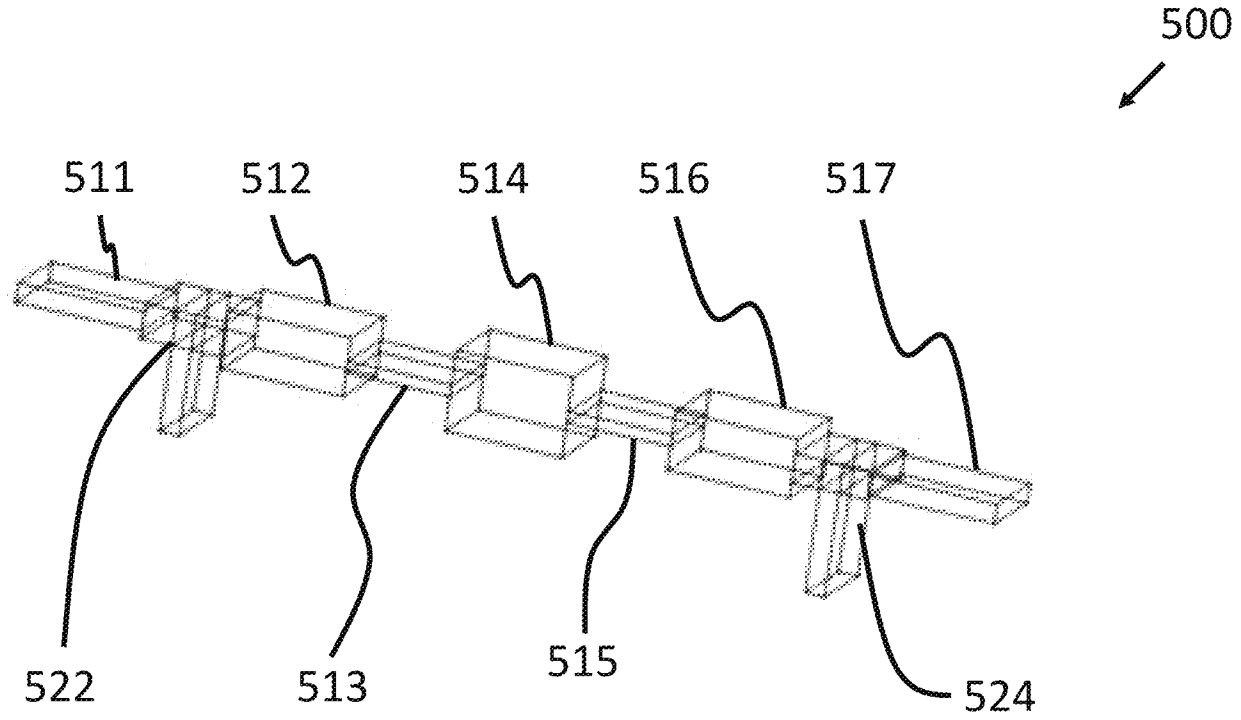
FIG. 5 shows a perspective view of a filter, according to one or more embodiments shown and described herein.

FIG. 5 shows an arrangement of a filter 500. The filter 500 has similar components to the filter 300 shown in FIG. 3. Features of filter 500 that are the same or equivalent to those in filter 300 have been indicated with their numerals increase by 200. These may not be discussed again for efficiency.

The filter 500 is in a form produced by combining seven CLSs 511, 512, 513, 514, 515, 516, 517, with two SMCLSs 522, 524. The stubs are shown in the example of FIG. 5 and can be seen to project downwardly from the main axis along which the CLSs 511 to 517 and the SMCLSs 522, 524 are arranged. The stubs of the filter 500 shown in the example of FIG. 5 are structurally larger than the stubs of the filter 300 shown in the example of FIG. 3. As with the embodiment of a filter 300 shown in FIG. 3, one SMCLS 522 is connected between the first CLS 511 and second CLS 512 and the other SMCLS 522 is connected between the sixth CLS 516 and the seventh CLS 517.

Figure 6:
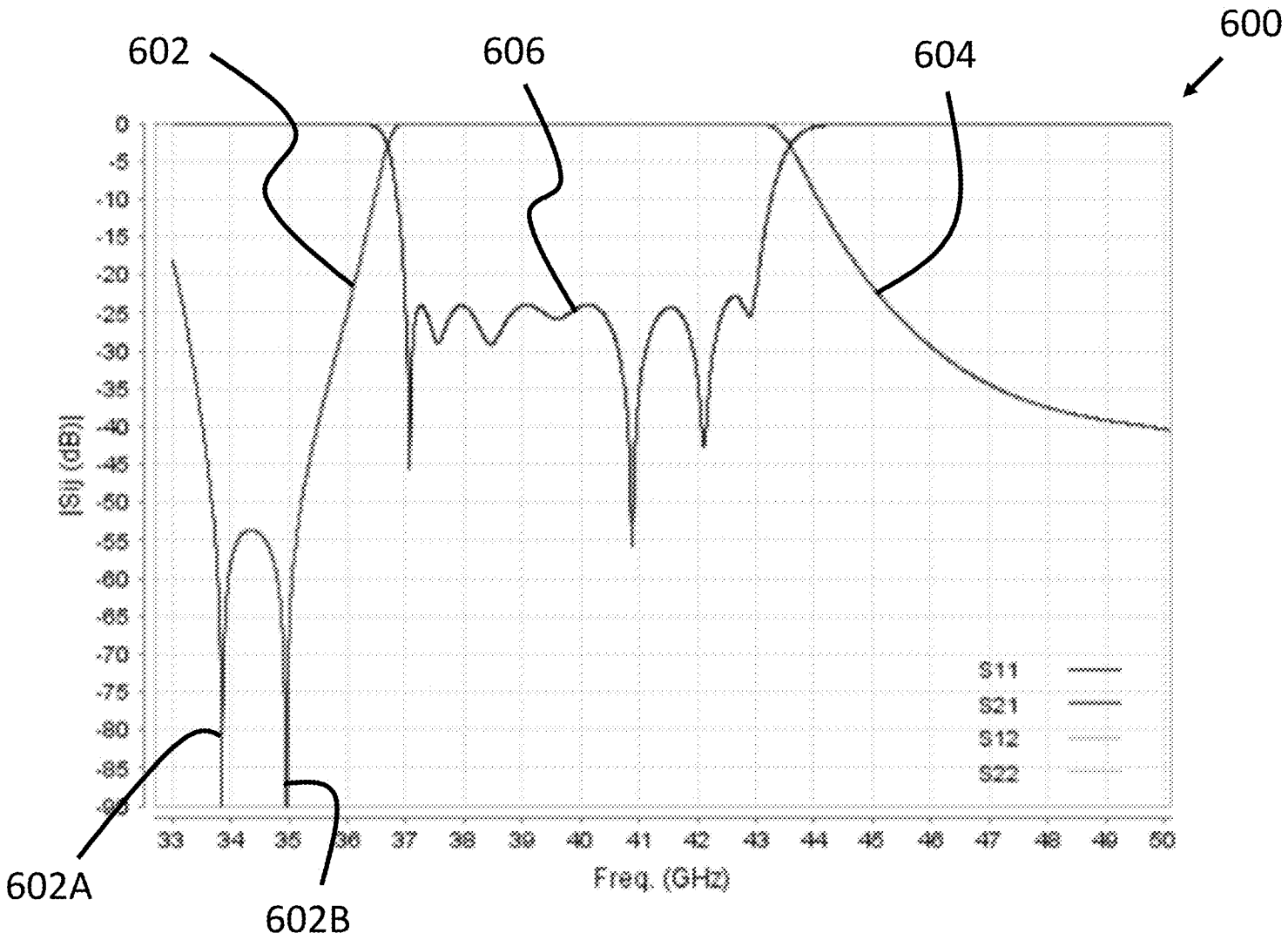
FIG. 6 shows a graph plot of the filter response provided by the filter of FIG. 5, according to one or more embodiments shown and described herein.

The performance of the filter 500 is illustrated as a graph plot 600 in FIG. 6. The graph plot 600 is a similar plot to that shown in FIG. 4, in terms of the axes and the lines plotted on the graph plot 400. The line shapes of the plot 600 are different to those in plot 400.

The plot 600 illustrates that the filter 500 provides a rejection of around −40 dB at a band around the frequency of 50 GHz. This response of the filter 500 is shown by line portion 604. Turning to line portion 602 as shown in FIG. 6, the plot 600 also illustrates that the filter 500 provides two transmission zeros at around 34 GHz and around 35 GHz. These two transmission zeros are shown within line portion 602 as line portions 602A and 602B for the 47 GHz and 49 GHz transmission zeros respectively.

Notably, the plot 600 shown in FIG. 6 has the two transmission zeros, illustrated in plot 600 by line portions 602A and 602B, located in the S21 plot on the left side (lower frequency end) of the stopband. As with FIGS. 2 and 4, the characterization of the input of the filter 500 is shown by the S11 plot shown in plot 600. This plot is shown by line 606. As shown in FIG. 6, there are 7 poles in line 606. This corresponds to the seven CLSs 511 to 517 in the filter 500.

Therefore, by adjusting the physical properties of the bandstop elements, it is possible to insert transmission zeros selectively into the response of the filter. These transmission zeros may be inserted into the left or the right side of the stopband as shown in the embodiments of FIGS. 3 to 6. Further arrangements utilizing the teachings disclosed herein may be used to obtain transmission zeros in any places in the response of the filter. Any SMCLSs in the filter may be connected between any of the CLSs and optimized according to the desired response of the filter.

Figure 7:
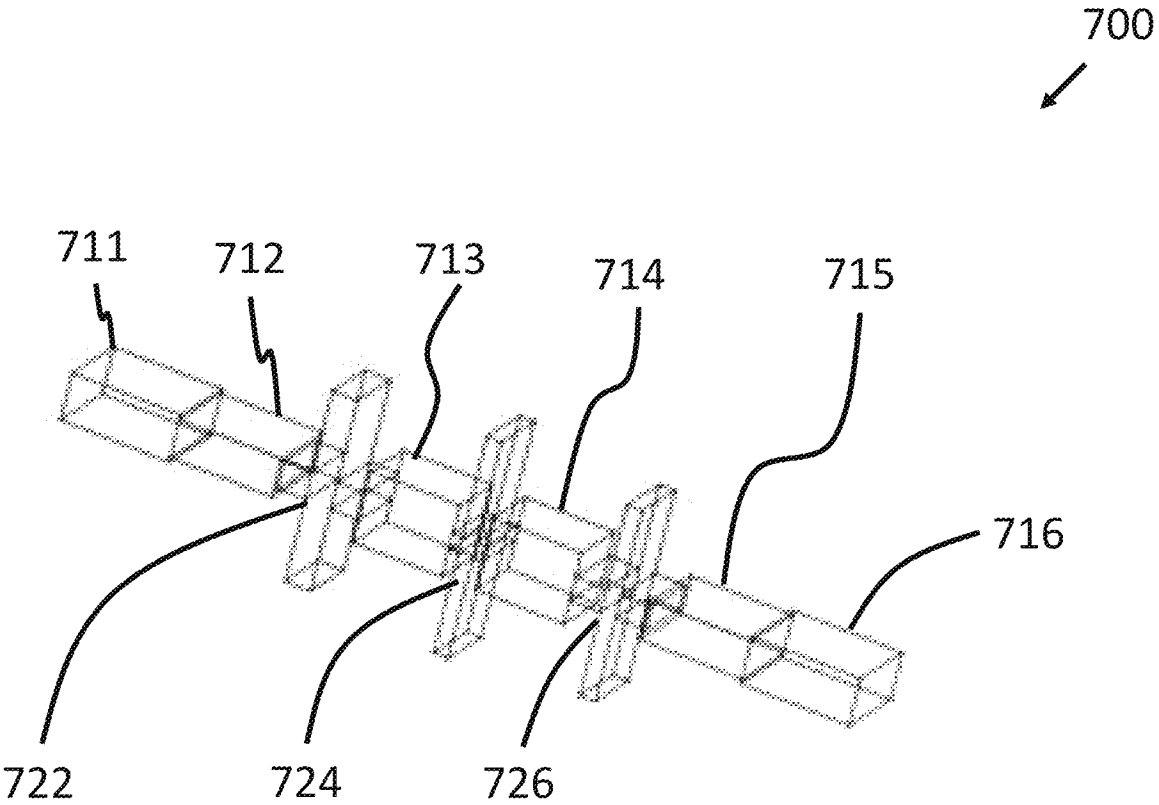
FIG. 7 shows a perspective view of a filter, according to one or more embodiments shown and described herein.

FIG. 7 shows an arrangement of a filter 700. The filter 700 has a number of similar components to the filter 500 shown in FIG. 5. Features of filter 700 that are the same or equivalent to those in filter 500 have been indicated with their numerals increase by 200. These may not be discussed again for efficiency.

The filter 700 is in a form produced by combining six CLSs 711, 712, 713, 714, 715, 716, with three SMCLSs 722, 724, 726. The stubs shown in the embodiment of FIG. 7 differ to those of the filters 300, 500 shown in FIGS. 3 and 5 respectively. The stubs are present on three SMCLSs 722, 724, 726 rather than two SMCLSs as in the filters 300, 500 of FIGS. 3 and 5. The stubs on the three SMCLSs 722, 724, 726 in the example shown in FIG. 7 project both upwardly and downwardly from the main axis along which the CLSs 711 to 716 and the SMCLSs 722, 724, 726 are arranged.

The stubs of the filter 700 shown in the example of FIG. 7 are structurally larger than the stubs of both filters 300, 500 shown in the examples of FIGS. 3 and 5. The stubs of the SMCLSs 722, 724, 726 project both upwardly and downwardly rather than just downwardly as in previous examples of filters 300, 500. As with the embodiments of the filters 300, 500 shown in FIGS. 3 and 5, the SMCLSs 722, 724, 726 are connected on either side to CLSs. The first SMCLS 722 is connected to the second CLS 712 and the third CLS 713. The second SMCLS 724 is connected to the third CLS 713 and the fourth CLS 714. The third SMCLS 726 is connected to the fourth CLS 714 and the fifth CLS 715. In this embodiment, the first CLS 711 is connected to the second CLS 712 and the sixth CLS 716 is connected to the fifth CLS 715. This arrangement is shown in FIG. 7.

As with previous embodiments, the SMCLSs 722, 724, 726 may be designed separately from the CLSs 711 to 716 and combined after manufacture. After the components are combined, the SMCLSs 722, 724, 726 are optimized slightly so that the filter 700 provides the desired performance.

Figure 8:
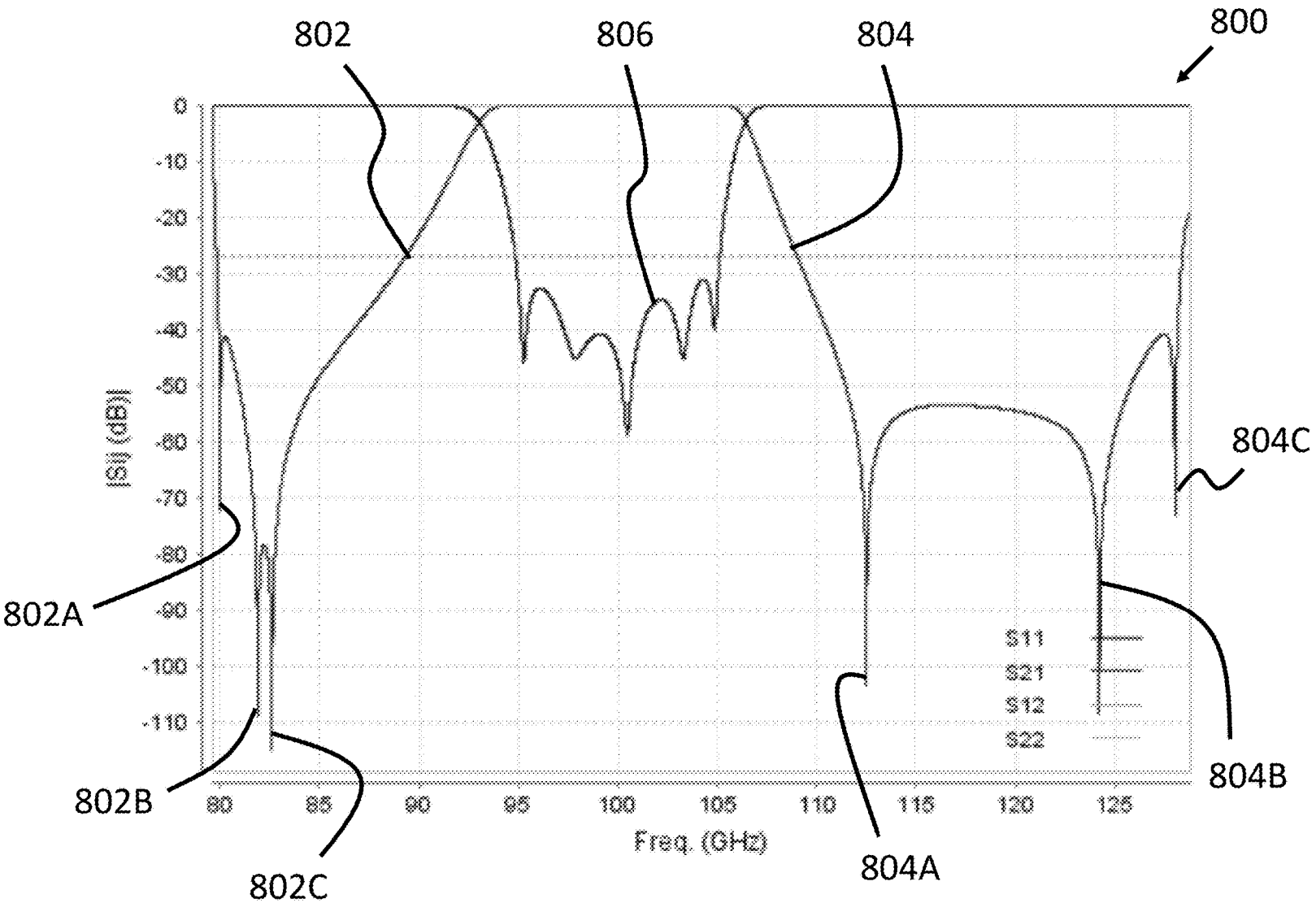
FIG. 8 shows a graph plot of the filter response provided by the filter of FIG. 7, according to one or more embodiments shown and described herein.

The performance of the filter 700 is illustrated as a graph plot 800 in FIG. 8. The graph plot 800 is a similar plot to that shown in FIGS. 4 and 6, in terms of the axes and the lines plotted on the graph plots 400, 600. The line shapes of the plot 800 are different to those in plots 400, 600.

The plot 800 illustrates that the filter 700 provides a distinctive series of rejection bands as shown by the line portions 802 and 804. The rejection bands are located in both the left and the right side of the stopband. The formation of the SMCLSs 722, 724, 726 in the filter 700 result in the transmission zeros located at both the lower and higher frequency ends of the plot 800. The response of the filter 700 is shown by line portions 802, 804.

Turning to line portion 802 as shown in FIG. 8, the plot 800 illustrates that the filter 700 provides three transmission zeros at around 80 GHz, 82 GHz and 83 GHz. These three transmission zeros are shown within line portion 802 as line portions 802A, 802B and 802C for the 80 GHz, 82 GHz and 83 GHz transmission zeros respectively.

Turning to line portion 804 as shown in FIG. 8, the plot 800 illustrates that the filter 700 provides three transmission zeros at around 112 GHz, 124 GHz and 127 GHz. These three transmission zeros are shown within line portion 804 as line portions 804A, 804B and 804C for the 112 GHz, 124 GHz and 127 GHz transmission zeros respectively.

The plot 800 therefore illustrates that a filter 700 having three SMCLSs 722, 724, 726 may produce six transmission zeros in the filter response. Each SMCLS of the presently disclosed filter may therefore provide multiple transmission zeros. Furthermore, these transmission zeros are relatively close to the passband and are therefore of significant use for controlling the response of the filter. Therefore, the presently disclosed filter may provide a greater number of transmission zeros in the filter response using a relatively small number of structures to do so. This in part leads to ease of construction and optimization of the presently disclosed filter. Indeed, the ease of construction of the filter disclosed herein alongside the effective rejection bands provided by the filter provides significant advantages over modern systems.

As with FIGS. 2, 4 and 6, the characterization of the input of the filter 700 is shown by the S11 plot shown in plot 800. This plot is shown by line 806. The line 806 contains 7 poles although only 5 are well highlighted. Some poles may be partially overlapping with other poles. Full optimization of the filter 700 may lead to more clearly defined poles.

The presently disclosed embodiments are applicable to different structures with different order (stepped-impedance sections) and different number of transmission zeros (stopband elements) and at different frequencies with excellent results. The embodiments shown in FIGS. 3 to 6 are, in addition to other applications, suitable for Q-band applications (i.e., the transmission filter of a Q-band diplexer from, e.g., a satellite perspective). The present disclosure is also applicable to the W-band. In the particular example of a filter 700 shown in FIGS. 7 and 8 for example, the passband is defined between 95 GHz and 105 GHz with more than 50 dB of attenuation between 81-85 GHz and 112-125 GHz.

The above described filters may have WR10 standard ports and a minimum mechanical gap higher than around 0.4 mm which allows a future fabrication in clam-shell configuration cut by the E-plane. Such a construction may have advantages in relation to insertion loss and passive intermodulation (PIM) point-of-view. It has been found that current filters constructed by this technique have a slightly larger size than classical inductive iris filters and the insertion losses are slightly higher however filters according to various embodiments of the present disclosure are operable at higher frequencies, relative to conventional filters.

Filters according to embodiments of the present disclosure may also maintain performance in the face of manufacturing tolerances of presently used techniques. It is advantageous for the performance of a filter to remain largely unaffected in the face of manufacturing inaccuracies. This enables a more varied collection of manufacturing techniques to be used which in turn reduces the overall cost of the filter. The embodiments of the filter described herein have been found to perform in such a way that 86% of filters were shown to fulfil their filtering specifications in the face of ±20 μm manufacturing tolerances. In contrast, a classical $8^{th}$ order inductive-iris filter performed at 0% fulfilling their filtering specifications in the face of ±20 μm manufacturing tolerances. Accordingly, embodiments as described herein have a significantly improved resilience to manufacturing tolerances.

A number of advantages stem from the presently disclosed filter embodiments which include: low cost design and assembly, integration and test (AIT) both in actual cost and time cost; very high rejection filters are easily achieved for high frequency applications; and, enabling separate design and assembly steps without impacting performance which in turn leads to simplistic construction and optimization of the filter. The filters disclosed herein may be applied at least to systems operating in the microwave and millimeter-wave frequency bands. In an example, the filters designed according to the disclosure herein may be applied at least to systems operating in frequencies ranging from 1 GHz to 300 GHz.

The filters disclosed herein have application at any wavelength. In particular, however, the filters disclosed herein may be used in any high frequency RF systems (transponders for Q/V/W bands, radiometers, telecoms projects at Q/V/W bands, use in 5G communication systems, etc.).

A further advantage of this present disclosure relates to the avoidance of quasi-optical bulky systems for application beyond around 100 GHz. This is a result of a limitation of implementing a guided selection of the spectrum through parts based on waveguide technology is the sensitivity to manufacturing tolerances and losses. Conventional solutions for high frequencies are therefore often quasi-optical systems. As embodiments of the present disclosure disclosed herein are more robust to manufacturing errors and also more compact by virtue of the implementation, disclosed herein, of transmission zeros, the solution is much more compact than conventional systems.

Thus there has been disclosed various embodiments of a filter for filtering wavelengths of an electromagnetic signal to provide a filtered signal, the filter comprising a plurality of stub-modified commensurate-line structure (SMCLS) arranged to provide at least a corresponding plurality of transmission zeros in the filtered signal.

There has also been disclosed a filter for filtering wavelengths of an electromagnetic signal to provide a filtered signal, the filter comprising: at least one commensurate-line structure (CLS); and, at least one stub-modified commensurate-line structure (SMCLS) arranged to provide a corresponding at least one transmission zero in the filtered signal.

What is claimed is:

1. A filter for filtering wavelengths of an electromagnetic signal to provide a filtered signal, the filter comprising:
- at least one commensurate-line structure (CLS);
- at least one stub-modified commensurate-line structure (SMCLS) arranged to provide a corresponding at least one transmission zero in the filtered signal;
- at least one higher impedance structure; and
- at least one lower impedance structure comprising one of the at least one SMCLS and one of the at least one CLS.

2. The filter of claim 1, wherein the at least one CLS and the at least one SMCLS form a band-pass filter.

3. The filter of claim 1, wherein the at least one CLS or the at least one SMCLS is a rectangular waveguide.

4. The filter of claim 1, wherein the at least one SMCLS performs an extracted pole.

5. The filter of claim 1, wherein the filter is arranged to provide the filtered signal in microwave and millimeter-wave frequency bands.

6. The filter of claim 1, wherein the filter comprises the at least one CLS and at least one SMCLS arranged to form a stepped-impedance structure.

7. The filter of claim 1, wherein at least one SMCLS is positioned adjacent to the at least one CLS.

8. The filter of claim 7, wherein the at least one SMCLS comprises a quarter-wave bandstop element and is connected to the at least one CLS.

9. The filter of claim 8, wherein the quarter-wave bandstop element is positioned in the at least one SMCLS and is connected to:
- a higher impedance section of the at least one CLS; or
- a lower impedance section of the at least one CLS.

10. The filter of claim 1, wherein at least one stub of the at least one SMCLS projects upwardly, downwardly, or both, from an axis along which the at least one CLS and the at least one SMCLS are arranged.

11. The filter of claim 1, wherein at least one stub of the at least one SMCLS projects upwardly and downwardly from an axis along which the at least one CLS and the at least one SMCLS are arranged.

12. A method for constructing a filter for filtering wavelengths of an electromagnetic signal to provide a filtered signal, the method comprising:
- providing at least one commensurate-line structure (CLS);
- providing at least one stub-modified commensurate-line structure (SMCLS);
- positioning the at least one SMCLS adjacent to the at least one CLS, wherein the filter comprises at least one higher impedance structure and at least one lower impedance structure; and
- incorporating at least one of the at least one SMCLS within at least one of the at least one lower impedance structure.

13. The method of claim 12, wherein providing at least one SMCLS comprises:
- providing at least one quarter-wave bandstop element as part of the at least one SMCLS,
- wherein the at least one quarter-wave bandstop element is arranged to provide one transmission zero in the filtered signal.

14. The method of claim 13, wherein the at least one quarter-wave bandstop element is arranged to provide one transmission zero within the frequencies 1 GHz to 300 GHz.

15. A filter for filtering wavelengths of an electromagnetic signal to provide a filtered signal, the filter comprising:
- a plurality of stub-modified commensurate-line structures (SMCLS) arranged to provide at least a corresponding plurality of transmission zeros in the filtered signal;
- at least one higher impedance structure; and
- at least one lower impedance structure comprising one of the plurality of SMCLS and at least one commensurate-line structure (CLS).

16. The filter of claim 15, wherein at least one of the plurality of SMCLS performs an extracted pole.

* * * * *